US005079857A

United States Patent [19]

Clifton

[11] Patent Number: 5,079,857

[45] Date of Patent: Jan. 14, 1992

[54] SHOE HAVING A DETACHABLE HEEL

[76] Inventor: Barrieann C. Clifton, 116 Locust St., Smyrna, Del. 19977-1524

[21] Appl. No.: 621,380

[22] Filed: Nov. 30, 1990

[51] Int. Cl.[5] ..... A43B 21/36

[52] U.S. Cl. ..... 36/42; 36/36 R

[58] Field of Search ..... 36/36 R, 36 A, 36 B, 36/36 C, 42

[56] References Cited

U.S. PATENT DOCUMENTS

| | | | |
|---|---|---|---|
| 835,515 | 11/1906 | Giovana | 36/36 R |
| 1,234,508 | 7/1917 | Sztari | 36/36 R |
| 2,439,310 | 4/1948 | Mancuso | 36/42 |
| 3,805,418 | 4/1974 | Matuka et al. | 36/42 X |
| 4,670,996 | 6/1987 | Dill | 36/42 |
| 4,805,320 | 2/1989 | Goldenberg et al. | 36/42 |
| 4,924,607 | 5/1990 | Harper | 36/42 |

FOREIGN PATENT DOCUMENTS

| | | | |
|---|---|---|---|
| 1246792 | 4/1961 | France | 36/42 |
| 2613598 | 10/1988 | France | 36/42 |

*Primary Examiner*—Paul T. Sewell
*Assistant Examiner*—Ted Kavanaugh
*Attorney, Agent, or Firm*—Abdallah & Muckelroy

[57] ABSTRACT

A shoe having a detachable heel. The shoe includes a foot receptacle portion having a threaded stem extending downwardly from the foot receptacle portion and a locking pin slot, and a shoe heel threadedly engageable to the stem and having a locking pin assembly which engages the locking pin slot to secure the heel in a fixed position.

2 Claims, 1 Drawing Sheet

SHOE HAVING A DETACHABLE HEEL

BACKGROUND OF THE INVENTION

The present invention generally relates to footwear. More specifically this invention relates to footwear having detachable heels.

The advantages of a shoe having a detachable heel are generally understood in the art. In modern urban society women in the workplace often wear a pair of walking shoes such as sneakers to and from the workplace and change to a more business type footwear for the office. A shoe having a detachable heel eliminates the need to carry an extra pair of shoes by permitting the wearer to wear a low heel shoe to and from the workplace and convert the same shoe to a higher heel for the office. Also, a detachable heel can be replaced when it becomes worn without having to take the shoes to a repair shop.

Various constructions for a shoe having a detachable heel have been proposed in the prior art. These shoes of the prior art can be divided into two general categories: (1) shoes having a heel that is slidably detachable, and (2) shoes having a heel that is attached to a pin member or screw that extends downwardly from the bottom of the shoe. Exemplary prior art of the first category is shown in U.S. Pat. No(s). 1,550,516; 1,516,381; 1,563,984; 1,588,684; 1,591,516; 1,593,915; 1,613,710; 1,633,449; 1,643,294; 1,749,864; 3,040,453; 3,176,417; 3,646,497; 3,797,136; and 4,610,100. Exemplary prior art of the second category is shown in U.S. Pat. No(s). 1,948,967; 3,478,447; 3,805,418; 4,409,745; and 4,670,996.

The prior art shoes having a detachable heel generally comprise complicated, multi-component assemblies. Such constructions prevent the development of a marketable shoe having a detachable heel because complex constructions cannot be manufactured at a cost-effective price and cannot be utilized in the fast-paced world where it is most needed. The primary market for a shoe having a detachable heel are working women. For the shoe to be favorably received by this market the heel must be easily and quickly detachable. Also it is important that the shoe maintain a pleasing appearance when used with any height of heel.

SUMMARY OF THE INVENTION

The present invention is a shoe having a detachable heel that permits quick and easy conversion of a shoe from a low heel shoe to a high heel shoe. The shoe includes a foot receptacle portion having a threaded stem extending downwardly from a heel plate fixedly attached to the bottom of the foot receptacle portion which selectively receives a shoe heel in threaded engagement. A spring-biased locking pin is disposed in the shoe heel which engages a locking pin slot formed in the heel plate of the foot receptacle portion.

An object of the present invention is to provide a shoe having a detachable heel that can be converted from a low heel shoe to a high heel shoe without the use of any tools.

It is also an object of this invention to provided a detachable heel for a shoe that can be locked in place for a secure attachment of the heel to prevent slipping or falling.

Another object of this invention is to provide a shoe having a detachable heel that can be easily and quickly exchanged for a heel of a different style or height.

A further object of the present invention is to provide a shoe having a detachable heel of simple construction to facilitate provision of a marketable product.

These and other advantages of the present invention will be apparent to those skilled in the art form the following description of a preferred embodiment, claims and appended drawings.

DESCRIPTION OF A PREFERRED EMBODIMENT

Figure 1:
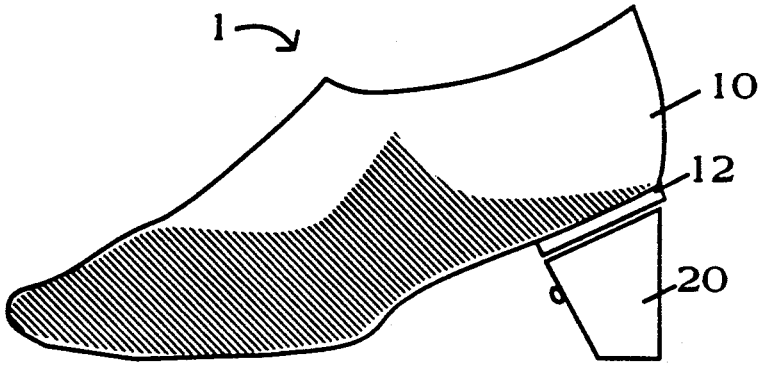
FIG. 1 is a side plan view of a shoe having a detachable heel constructed in accordance with the teachings of the present invention.
Figure 2:
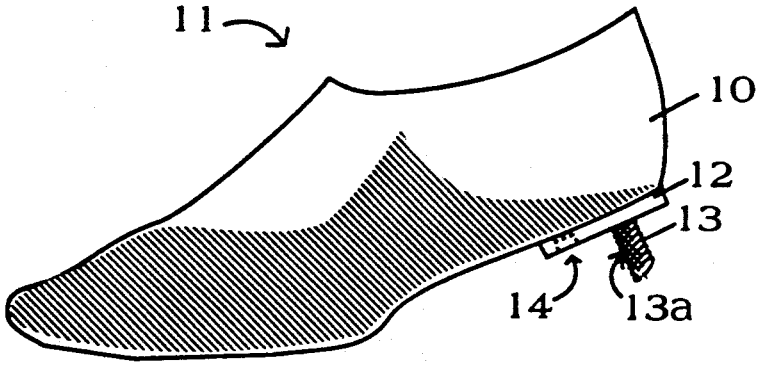
FIG. 2 is a side plan view of the foot receptacle portion of the shoe.

FIG. 1 illustrates in a side plan view a shoe 1 constructed in accordance with the teachings of the present invention. Shoe 1 generally comprises a foot receptacle portion 10 and a detachable shoe heel 20. As can be best seen in FIGS. 2 and 3 foot receptacle portion 10 includes a foot receptacle 11, a heel plate 12 fixedly attached to the rear bottom portion 11*a* of the foot receptacle 11, a threaded stem 13 extending downwardly from the heel plate 12 and fixedly attached thereto, and a locking pin slot 14 formed in the heel plate 12 in spaced relationship from said threaded stem 13. Foot receptacle 11 may be formed in any of a variety of shoe styles. Foot receptacle 11 is preferably from a material of sufficient flexibility to permit foot receptacle 11 to retain comfortable conformity with a wearer's foot disposed therein when the shoe 1 is converted to and from a low heel shoe to a high heel shoe.

Figure 3:
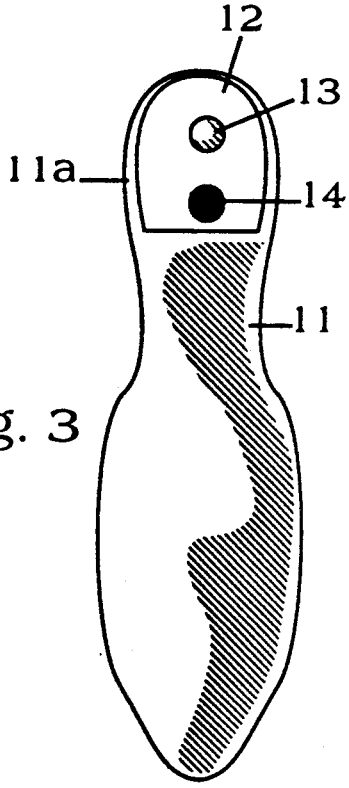
FIG. 3 is a bottom plan view of the foot receptacle portion of the shoe.

Heel plate 12 is preferably a solid, relatively thin metal plate fixedly attached to shoe receptacle 11 by glued attachment. The threaded stem 13 extending downwardly from said heel plate 12 has threads 13*a* formed on the outer surface of said stem 13 for the length of the stem 13. The locking pin slot 14 is a recessed opening in said heel plate 12. As can be seen in FIG. 3 stem 13 and locking pin slot 14 are preferably longitudinally aligned in the heel plate 12.

Figure 4:
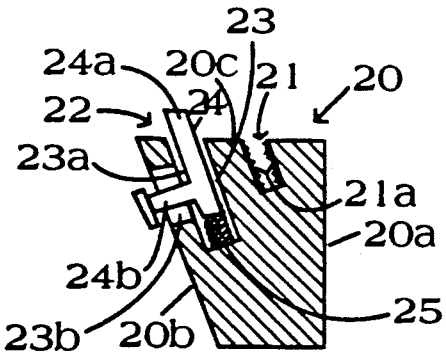
FIG. 4 is a vertical cross-sectional view of the shoe heel of the present invention.
Figure 5:
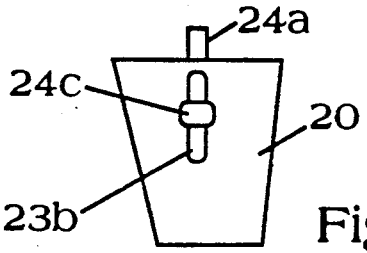
FIG. 5 is a front plan view of the shoe heel.

Referring now to FIGS. 4 and 5 the shoe heel 20 is shown in greater detail. In the vertical cross-sectional view of shoe heel 20 illustrated in FIG. 4 it can be seen that shoe heel 20 is formed having a vertical rear wall 20*a* and an angled forward wall 20*b*. A stem slot 21 extends from the top wall 20*c* of the shoe heel 20 into the body of said shoe heel 20. The upright walls 21*a* of stem slot 21 have threads formed therein which complement the threads 13*a* of the stem 13 of the foot receptacle portion 10. The stem threads 13*a* and the complementary threads formed in the upright walls 21*a* of the stem slot 21 are sufficient in number so that when the shoe heel 20 is threadedly attached to stem 13 and the top wall 20*c* of shoe heel 20 is brought in close, locking engagement with the heel plate 12, the vertical rear wall 20*a* of shoe heel 20 is disposed to the rear of shoe receptacle portion 10.

Shoe heel 20 further includes a locking pin assembly 22 forwardly disposed from said stem slot 21. Locking pin assembly 22 is disposed in a slotted opening 23 which communicates with the top wall 20c and the forward wall 20b of the shoe heel 20. Locking pin assembly 22 generally comprises a substantially T-shaped locking pin 24 and a biasing spring 25. Biasing spring 25 outwardly biases an end of a locking pin slot engaging portion 24a of said locking pin 24 above the top wall 20c of shoe heel 20 as hereinafter described in greater detail.

The slotted opening 23 in said shoe heel 20 has a substantially vertical portion 23a which extends from the top wall 20c of shoe heel 20, and a transverse portion 23b which extends from the vertical portion 23a to the forward wall 20b of shoe heel 20. The locking pin slot engaging portion 24a of locking pin 24 is disposed in sliding engagement within the substantially vertical portion 23a of slotted opening 23. An end of said locking pin slot engaging portion 24a is biased above the top wall 20c of shoe heel 20 by biasing spring 25 which is disposed adjacent to the bottom wall of the vertical portion 23a of slotted opening 23. A locking pin guide portion 24b is fixedly attached to said locking pin slot engaging portion 24a and extends through the transverse portion 23b of said slotted opening 23. Locking pin guide portion 24b moves vertically within the transverse portion 23b to move the locking pin slot engaging portion 24a within said vertical portion 23a of slotted opening 23. Locking pin guide portion 24b includes a guide portion tab 24c disposed adjacent to the forward wall 20b of shoe heel 20.

The simple construction of the shoe 1 of the present invention permits shoe heel 20 to be quickly and easily changed by a person having little or no mechanical skill. To remove a shoe heel 20, the locking pin slot engaging portion 24a of locking pin 24 is released from the locking pin slot 14 of the foot receptacle portion 10 by pressing downwardly on the guide portion tab 24c of the locking pin guide portion 24b. The shoe heel 20 is then rotated about the threaded stem 13 and removed from the foot receptacle portion 10 of shoe 1. To affix another heel, a shoe heel 20 having the desired height is threadedly attached by engaging the stem 13 with the stem slot 21 and rotating shoe heel 20 about stem 13. When shoe heel 20 moves into close engagement with the heel plate 12 of the foot receptacle portion 10, the locking pin slot engaging portion 24a of shoe heel 20, being outwardly biased by biasing spring 25 but slidably disposed in the vertical portion 23a of the slotted opening 23, is caused to be moved downwardly by bearing contact with heel plate 12 and by the biasing action of biasing spring 25 is caused to snap into locking pin slot 14 when aligned therewith. If locking pin slot engaging portion 24a of locking pin 24 prematurely engages locking pin slot 14, the locking pin slot engaging portion 24a may be manually moved downwardly to release said locking pin slot engaging portion 24a while turning shoe heel 20 about stem 13 to bring said shoe heel 20 in close, tightly fitting engagement with said foot receptacle portion 10.

Various changes and modifications may be made to the preferred embodiment of the present invention without departing from the spirit and scope of the present disclosure. Such changes and modifications within a fair reading of the following claims are intended as part of the present invention.

Therefore, in view of the foregoing, I claim:

1. A shoe having a detachable heel comprising a foot receptacle portion comprising a foot receptacle and a heel plate fixedly attached to said foot receptacle, said heel plate having a stem having a threaded portion extending downwardly from said heel plate and a locking pin slot disposed in spaced relationship from said stem; and a detachable shoe heel selectively and threadedly engageable to the threaded portion of the stem of said foot receptacle portion, said shoe heel having a threaded slot complementarily engageable with said threaded portion of the stem and a locking pin assembly selectively engageable with said locking pin slot, wherein said locking pin assembly is disposed in a slotted opening formed in said shoe heel, said slotted opening having a substantially vertical portion which extends from a top wall of said shoe heel to within said shoe heel and a transverse portion which extends from said vertical portion to a forward wall of said shoe heel, a substantially T-shaped locking pin being slidably disposed in said slotted opening, said locking pin having a locking pin slot engaging portion disposed in the vertical portion of said slotted opening and a locking pin guide portion fixedly attached to said locking pin slot engaging portion and extending in transverse sliding engagement through said transverse portion of said slotted opening, said locking pin slot engaging portion being outwardly biased above the top wall of said shoe heel by a biasing spring disposed in said vertical portion of said slotted opening.

2. A shoe as in claim 1 having a guide portion tab fixedly attached to said locking pin guide portion adjacent to said forward wall of said shoe heel.

* * * * *